US007128055B2

(12) United States Patent
Zdroik

(10) Patent No.: US 7,128,055 B2
(45) Date of Patent: Oct. 31, 2006

(54) FUEL INJECTOR CLOCKING FEATURE

(75) Inventor: Michael J. Zdroik, Metamora, MI (US)

(73) Assignee: Millennium Industries, Corp., Auburn Hills, MI (US)

( * ) Notice: Subject to any disclaimer, the term of this patent is extended or adjusted under 35 U.S.C. 154(b) by 1 day.

(21) Appl. No.: 10/873,782

(22) Filed: Jun. 22, 2004

(65) Prior Publication Data

US 2005/0279328 A1 Dec. 22, 2005

(51) Int. Cl.
*F02M 37/04* (2006.01)

(52) U.S. Cl. ..... 123/470; 123/468

(58) Field of Classification Search ..... 123/470, 123/469, 468, 467, 456; 239/600, 585.1, 239/585.2, 585.3, 88–96
See application file for complete search history.

(56) References Cited

U.S. PATENT DOCUMENTS 4,971,014 A * 11/1990 Usui ..... 123/470
4,984,548 A 1/1991 Hudson, Jr. ..... 123/470
4,991,557 A * 2/1991 DeGrace et al. ..... 123/470
5,040,512 A 8/1991 Twilton ..... 123/470
5,136,999 A * 8/1992 Bassler et al. ..... 123/470
5,209,204 A * 5/1993 Bodenhausen et al. ..... 123/470
5,394,850 A * 3/1995 Murphy et al. ..... 123/470
5,520,151 A 5/1996 Gras et al. ..... 123/470
6,019,089 A 2/2000 Taylor et al. ..... 123/470
6,082,333 A * 7/2000 Vattelana et al. ..... 123/456
6,199,539 B1 * 3/2001 Pearlman et al. ..... 123/470
6,374,809 B1 * 4/2002 Satou ..... 123/470
6,604,510 B1 * 8/2003 Scollard et al. ..... 123/470
6,863,054 B1 * 3/2005 Reiter et al. ..... 123/470

* cited by examiner

*Primary Examiner*—Carl S. Miller
(74) *Attorney, Agent, or Firm*—Dykema Gossett PLLC

(57) ABSTRACT

A fuel delivery system is provided having a fuel rail with an outlet. A fuel injector is provided having a body with an outlet and a generally tubular inlet. The tubular inlet of the fuel injector is generally axially slideable into the fuel rail outlet. The fuel injector outlet has a generally noncircular cross-sectional shape and is torsionally restrained by the fuel rail outlet.

17 Claims, 2 Drawing Sheets

FUEL INJECTOR CLOCKING FEATURE

FIELD OF THE INVENTION

The field of this invention is a fuel delivery system arrangement for connecting an electric-operated fuel injector between a fuel rail and an air intake manifold of a spark-ignited, internal combustion engine.

BACKGROUND OF THE INVENTION

Spark-ignited, fuel-injected internal combustion engines are often used in automotive vehicles. Fuel is injected into an intake system of such an engine by electric-operated fuel injectors of a fuel rail (sometimes referred to as a fuel manifold) assembled to the engine.

Targeted types of fuel injectors inject fuel into the vehicle engine in a direction, or directions, that are other than along the fuel injector axial centerline. A split stream fuel injector is an example of a targeted fuel injector. When a targeted fuel injector is used in an engine, the fuel injector has to have a particular angular or circumferential orientation about its centerline so that the direction(s) of fuel injection will be properly targeted. Improperly targeted fuel injectors may derogate engine performance and/or compliance with applicable vehicle emission requirements.

Proper targeting of a fuel injector typically requires a proper axial positioning of the fuel injector. This is typically achieved by positioning the fuel injector nozzle, which contains one or more metering orifices from which fuel is injected into an engine, in a fixed geometric relation to a socket receptacle of the engine intake system into which the nozzle is inserted in a sealed manner. When a fuel rail containing fuel injectors that have been properly circumferentially located in respective outlet cups of the fuel rail is assembled to an engine that has injector-receiving socket receptacles, the act of inserting the nozzles into properly sealed relationship with the socket receptacles can complete proper targeting of the fuel injectors. The achievement of the correct circumferential location of the fuel injector to the fuel rail outlet cup is referred to as "clocking" the fuel injector.

A fuel rail may comprise attachment features, apertured brackets for example, with which threaded fasteners are associated to fasten the fuel rail to an engine. Once the fuel injector nozzles have seated in properly targeted positions in the socket receptacles, a need for further tightening of such fasteners in order to secure the fuel rail on the engine may induce undesired stress, distortion and/or movement. For example, if fuel injector nozzles have been seated in properly targeted positions in respective socket receptacles in engine air intake manifold runners before the fuel rail attachment fasteners have been fully torqued, the fuel rail may distort in some way, and/or there may be some relative movement between some component parts, as the fasteners are finally tightened to full installation torque. With prevailing manufacturing methods and dimensional tolerances of manufactured parts, it seems that the possibility of such distortion, or movement of component parts, at time of fuel rail assembly to an engine, cannot be totally foreclosed in all circumstances.

It has been known to mechanically retain a fuel injector in a fuel rail outlet cup by a retention clip that constrains the two against any substantial movement, both circumferentially and axially. A fuel rail that incorporates such a capability may improve serviceability should it become necessary to remove the fuel rail from an engine and thereafter re-attach it.

Due to the enhanced stringency of vehicle emission requirements and the use of four-valve cylinder heads with two intake ports, it is now more important than ever to ensure that fuel injectors are properly clocked. Therefore the requirement that fuel injectors be properly clocked when inadvertently twisted during assembly or maintenance operations is greater than that previously required. Many prior fuel delivery system arrangements retain the fuel injector to the cup with a C-type clamp which when improperly torqued is subject to inadvertent opening.

It is desirable to provide a fuel delivery system arrangement for connecting the fuel injector between a fuel rail and air intake manifold of the vehicle engine wherein the clocking feature and the axial retention of the fuel injector to the fuel rail outlet cup can be separated.

SUMMARY OF THE INVENTION

The present invention provides an alternative apparatus and method of clocking a fuel injector to a fuel rail. It additionally allows the clocking feature to be separate from the axial retention of a fuel injector to a fuel rail.

Other features of the invention will become more apparent from a review of the drawings and description.

DETAILED DESCRIPTION OF THE INVENTION

Figure 1:
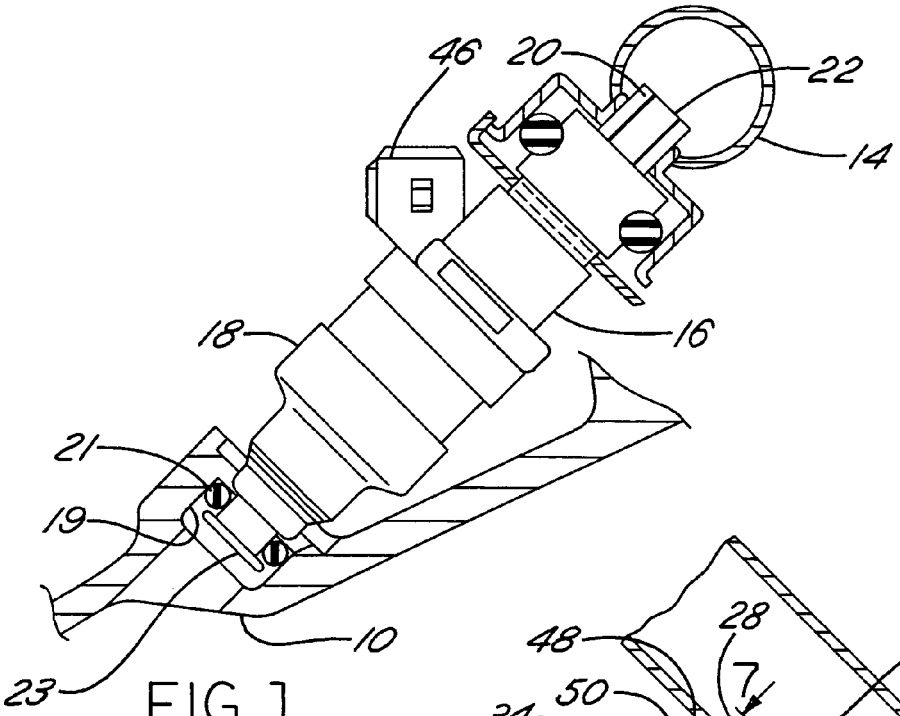
FIG. 1 is a side elevational view of a preferred embodiment of the present invention taken along a direction generally parallel with a fuel rail which delivers fuel to an intake manifold of a vehicle engine via a fuel injector.

FIG. 1 illustrates a preferred embodiment fuel delivery system arrangement 7 of the present invention for delivering pressurized fuel to an air intake manifold 10 of a spark-ignited, internal combustion engine. A fuel rail 14 and the air intake manifold 10 are configured for a multi-cylinder V-type engine. The fuel rail 14 is fluidly connected with a plurality of top feed electric-operated fuel injectors 16. Each cylinder (not shown) has its own open intake manifold runner.

Figure 2:
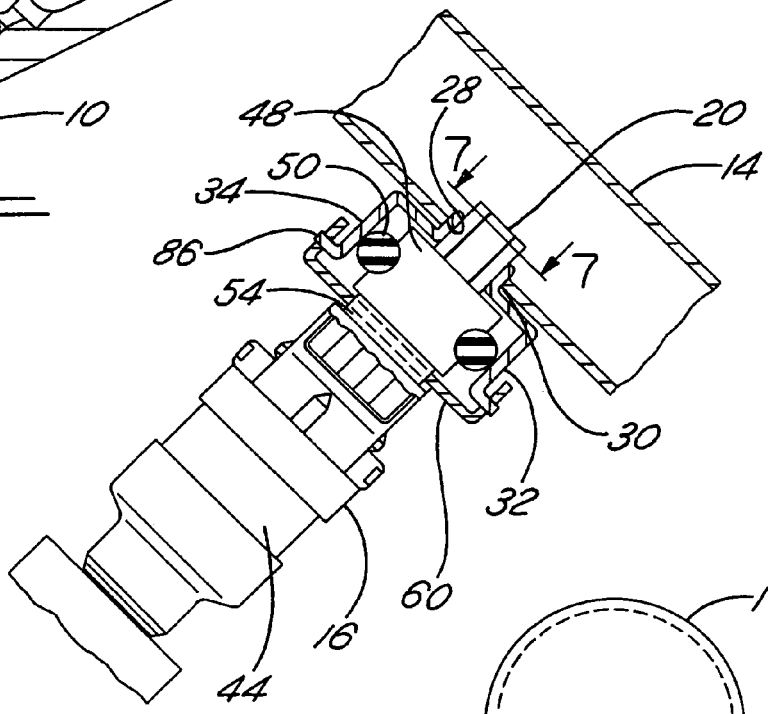
FIG. 2 is a view generally taken approximately 90° from the view shown in FIG. 1.
Figure 4:
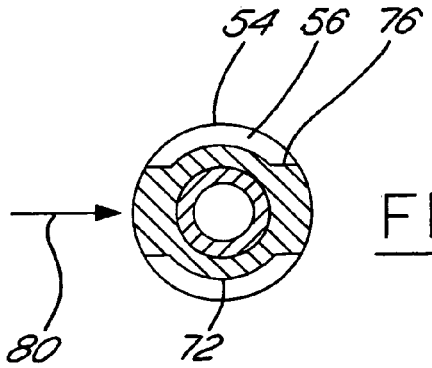
FIG. 4 is a sectional view taken along a neck portion of the fuel injector shown in FIGS. 1 and 2.

Referring additionally to FIGS. 2 and 4, each fuel injector 16 includes a body 18, having a tubular fuel inlet 20 at one axial end. A free end of fuel inlet 20 provides a fuel inlet opening 22 through which pressurized fuel can enter the fuel injector. (In most instances the fuel will be in liquid form.) An opposite axial end of fuel injector 16 comprises a nozzle 23 containing one or more metering orifices from which fuel is injected out of fuel injector body 18. A lower end of the fuel injector 16 is sealed within an inlet 19 of the air manifold runner by a sealing ring 21. As shown, the fuel injector 16 is a directed type fuel injector.

The fuel rail 14 as shown is circular; however, the fuel rail 14 can also have a rectangular shape. The fuel rail 14 has an outlet opening 28. Sealably connected with the opening 28 is a neck or inlet portion 30 of a cup 32. An interior of the cup neck 30 slideably receives the fuel injector inlet 20. The cup 32 has an enlarged portion 34 with an outlet opening to receive the body 18 of the fuel injector 16. The cup 32 in conjunction with the opening 28 provides an outlet for the fuel rail 14.

Figure 7:
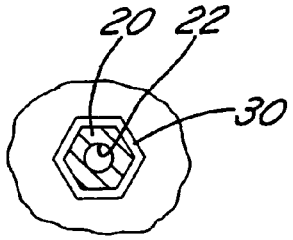
FIG. 7 is a view taken along line 7—7 of FIG. 2.
Figure 8:
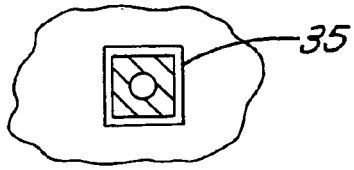
FIGS. 8, 9 and 10 are sectional views similar to that of FIG. 7 illustrating alternate preferred embodiments of the present invention.
Figure 9:
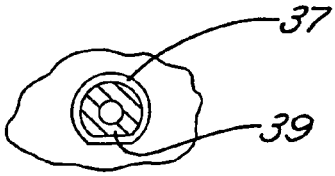
Figure 10:
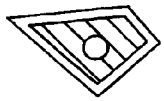

Turning to FIG. 7, the neck 30 of the cup 32 has a generally non-circular cross-sectional hexagonal shape. Other non-circular cross-sectional shapes may be utilized, as FIGS. 8 and 9 illustrate. In the embodiment of FIG. 8, neck 35 of the cup 32 is rectangular. In the embodiment of FIG. 9 the neck 37 has a flat 39 giving it a circle D configuration. In still other embodiments, the cross-sectional shape can be a non equilateral polygonal shape to insure only one clocking position, such as that shown in FIG. 11.

Injector inlet 20 is typically tubular in configuration and extends upwardly into the body 18 of the injector forming a core. The inlet 20 is one of the stronger structures of the injector 16. At a lower portion or end, the tubular member which end forms the inlet, is typically surrounded or encircled by electrical coils 44. The coils 44 receive power from the engine controller via a cable (not shown) which attaches to the electrical connector 46 of the injector. The injector inlet 20 is axially slideably insertable and has a perimeter closely aligned with the interior opening of the neck 30. Accordingly, the injector inlet 20 is a cross-sectional shape which matches that of neck 30. Although the inlet 20 can be freely inserted within the neck 30 of the cup 32, it is torsionally restrained and its angular orientation is set. Setting of the fuel injector angular orientation is often referred to in the industry as "clocking the fuel injector."

Figure 5:
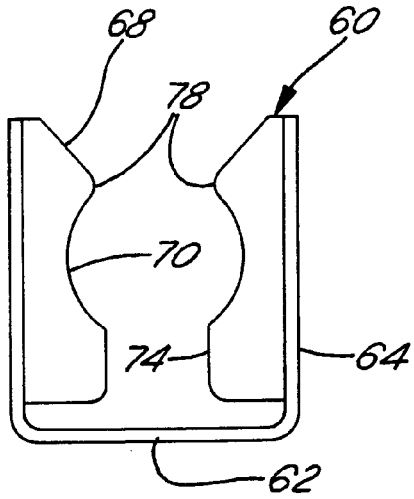
FIG. 5 is a top plan view of a clip utilized to axially retain the fuel injector to the fuel injector cup shown in FIGS. 1 and 2.
Figure 6:
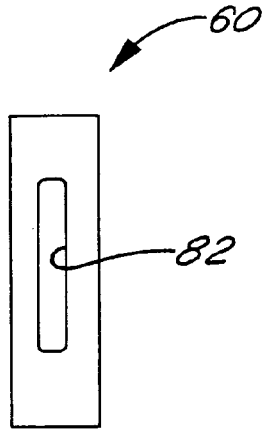
FIG. 6 is a side elevational view of the clip shown in FIG. 5.

Referring additionally to FIGS. 4–6, a seal face portion 48 is sealed within the cup 32 by a sealing ring 50. The fuel injector has a neck 54. A sectional view taken through the neck is best shown in FIG. 4. The neck 54 has general circumferential slots 56. The slots 56 are oriented to be generally lateral of the connector 46. It is a typical practice to retain the fuel injector 16 to the fuel rail 14 during assembly of the engine or during its maintenance. To axially retain the fuel injector 16 to the fuel rail 14, there is provided a clip 60. The clip 60 has a cross over portion 62 which connects two arms 64.

Each of the arms 64 has an ear 68. The ears 68 have a section 70 which engage a section 72 of the injector body. The ears 68 have abutment sections 74 to engage with the flat 76 of the injector. The clip ears have two points 78. The points 78 provide a gateway to ensure that the clip 60 is installed onto the injector from the direction of arrow 80 (from the direction of the connector 46). The arm 64 has two longitudinal slots 82 (FIG. 6). The slots 82 receive the outward extending flanges of the cup 86 (FIG. 2) and thereby interlockingly engage the clip with the cup 32 for axial retention.

The present invention provides several advantages over the prior art. One advantage is that the clocking feature which is achieved by inserting the fuel injector 16 into the outlet of the fuel rail 14 allows the angular retention of the fuel injector 16 to the fuel rail 14 to be independent of any features of the clip 60. Therefore, if the clip 60 is worn or deformed during improper installation or is inadvertently pushed, the functionality of the clip 60 will not affect the clocking function. The clocking function by the clip 60 with the fuel injector 16 enhances the clocking function. If desired, the flat 76 on the injector can be eliminated without affecting axial retention of the fuel injector to the cup 32 by the clip 60.

From a practical standpoint, the clocking feature will cause the fuel injector to be installed in such a position that the flat 76 is not required to insure that the injector is not attached to the fuel rail unless it is in the proper position. The clocking feature will enable the assembly operator to distinguish the center position versus an off-center position which would at least be approximately 60° off-center. To further insure proper installation, the flat 76 can be added to not allow engagement of the clip 60 to the injector 16 except from the direction of the arrow 80.

Figure 3:
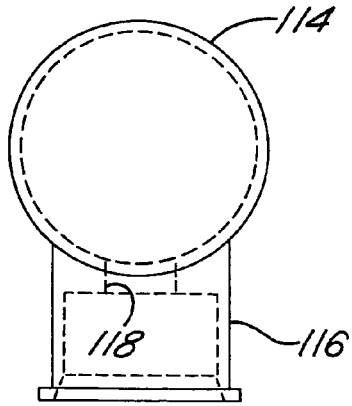
FIG. 3 is a front elevational view of a fuel rail and associated injector cup of an alternate preferred embodiment of the present invention.

It will be apparent to those skilled in the art that other clips can be utilized to axially retain the fuel injector 16 to the fuel rail 14. FIG. 3 shows a partial alternate embodiment of a much larger diameter fuel rail 114. A manifold type cup 116 can be integrally attached to the fuel rail with the manifold cup having a reduced inner diameter portion 118 providing the inlet from the fuel rail 114. The remainder of the invention in this embodiment is as previously described.

It is apparent to those skilled in the art that the present inventive fuel delivery system arrangement can utilize other types of clips to axially connect the injector to the cup and/or fuel rail. It is also apparent to those skilled in the art that various modifications can be made to the present invention without departing from the spirit and scope of the invention as it is encompassed by the following claims.

The invention claimed is:

1. A fuel delivery system arrangement comprising:

a fuel rail for delivering fuel, said rail having an outlet formed by a cup having an inlet neck connected to an outlet opening of said fuel rail, said cup inlet having an interior opening having a generally non-circular cross-sectional shape; and a fuel injector having a body with an outlet and a generally tubular inlet, said tubular inlet generally being axially slideable into said interior opening of said cup inlet, and wherein said fuel injector inlet having a generally noncircular cross-sectional shape corresponding to said generally non-circular cross-sectional shape of said interior opening of said cup inlet, and further wherein said fuel injector inlet restricts torsional movement of said fuel injector.

2. A fuel delivery system arrangement as described in claim 1 wherein said cup has an outlet which receives a portion of said fuel injector body.

3. A fuel delivery system arrangement as described in claim 1 wherein said fuel injector inlet is part of a core of said fuel injector body, said core being surrounded by a coil.

4. A fuel delivery system arrangement as described in claim 1 further including a clip to axially retain said fuel injector to said fuel rail.

5. A fuel delivery system arrangement as described in claim 4 wherein said injector body has a noncircular cross-sectional section and wherein said clip holds onto said injector body in said noncircular cross-sectional section and wherein said clip has retaining engagement with said fuel rail.

6. A fuel delivery system arrangement as described in claim 5 wherein said clip cannot be connected onto said fuel injector body unless said fuel injector is clocked in a predefined position.

7. A fuel delivery system arrangement as described in claim 1 further including a clip that axially retains said fuel injector to said cup.

8. A fuel delivery system arrangement as described in claim 7 wherein said injector body has a noncircular cross-sectional section and wherein said clip holds onto said injector body in said noncircular cross-sectional section and wherein said clip has retaining engagement with said cup.

9. A fuel delivery system arrangement as described in claim 8 wherein said clip cannot be connected onto said fuel injector body unless said fuel injector is clocked in a predefined position.

10. A fuel delivery system arrangement as described in claim 1 wherein said fuel injector inlet has a hexagonal cross-sectional shape.

11. A fuel delivery system arrangement as described in claim 1 wherein said inlet of said fuel injector cross sectional-shape has a circle D configuration.

12. A fuel delivery system arrangement as described in claim 1 wherein said fuel injector body inlet has a generally rectangular cross-sectional shape.

13. A fuel delivery system arrangement as described in claim 1 wherein said fuel injector body inlet has a generally non-equilateral cross-sectional shape.

14. A fuel delivery system arrangement comprising:

a fuel rail for delivery fuel to a plurality of cylinders of a spark-ignited internal combustion engine, said fuel rail having an outlet formed by a cup having a neck portion connected to an opening in said fuel rail, said neck portion being connected with an enlarged portion;

an electric-operated fuel injector having a body with an outlet and a generally tubular core inlet, said tubular inlet being generally axially slideable into said fuel rail outlet cup neck and said fuel injector inlet cross-sectional shape being generally noncircular and being torsionally restrained by said neck of said fuel rail cup; and a clip having locking engagement with a noncircular cross-sectional portion of said fuel injector body, said fuel injector clip having axially retentional engagement with said cup to axially retain said fuel injector body with said fuel rail.

15. A method of delivering pressurized fuel to an air intake of a spark-ignited internal combustion engine comprising:

providing a pressurized fuel rail with an outlet to distribute said fuel;

providing a fuel injector having a body including an inlet and outlet between said engine and said outlet of said fuel rail;

slideably inserting and clocking in an angular position for said fuel injector by slideably inserting said fuel injector body inlet into said fuel rail outlet and torsionally restraining said fuel injector by contact of said fuel injector inlet with said fuel rail outlet.

16. A method as described in claim 15 further including axially retaining said fuel injector by engaging said fuel injector with a clip having retaining engagement with a portion of said fuel rail.

17. A method as described in claim 16 wherein engaging of said fuel injector with said clip is only allowed when said fuel injector body is clocked with a correct orientation with said fuel rail.

* * * * *